US011684861B2

(12) United States Patent
Chen

(10) Patent No.: US 11,684,861 B2
(45) Date of Patent: Jun. 27, 2023

(54) TWO PIECE SLIDE

(71) Applicant: Samuel Chen, Causeway Bay (HK)

(72) Inventor: Samuel Chen, Causeway Bay (HK)

( * ) Notice: Subject to any disclaimer, the term of this patent is extended or adjusted under 35 U.S.C. 154(b) by 12 days.

(21) Appl. No.: 17/499,473

(22) Filed: Oct. 12, 2021

(65) Prior Publication Data

US 2023/0112047 A1 Apr. 13, 2023

(51) Int. Cl.
*A63G 21/02* (2006.01)
*A63G 21/00* (2006.01)

(52) U.S. Cl.
CPC ..... *A63G 21/02* (2013.01)

(58) Field of Classification Search
CPC ..... A53G 21/00; A53G 21/02; A63G 21/00; A63G 21/02
USPC ..... 472/116; 482/35, 36
See application file for complete search history.

(56) References Cited

U.S. PATENT DOCUMENTS

| | | | | |
|---|---|---|---|---|
| 4,299,171 | A | 11/1981 | Larson | |
| 4,943,048 | A * | 7/1990 | Hentges | A63G 21/00 182/49 |
| 5,860,867 | A | 1/1999 | Van Deusen | |
| 8,651,970 | B2 | 2/2014 | Chen | |
| 10,549,206 | B1 | 2/2020 | Nirwan | |
| 2011/0086717 | A1 | 4/2011 | Connors | |

* cited by examiner

*Primary Examiner* — Kien T Nguyen
(74) *Attorney, Agent, or Firm* — Clement Cheng

(57) ABSTRACT

A slide has a metal frame supporting a polymer slide portion. The slide portion has an upper slide section and a lower slide section connected to the upper slide section. The upper slide section and the lower slide section form an interface. The interface includes an interface middle section, an interface right upper extension, and an interface left upper extension. The interface middle section is offset from the interface right upper extension and the interface left upper extension. A left lengthwise interface section extends between the interface middle section and the interface left upper extension. A right lengthwise interface section extends between the interface middle section and the interface right upper extension. The left lengthwise interface section and the right lengthwise interface section are parallel to each other, but perpendicular to the interface middle section.

12 Claims, 8 Drawing Sheets

TWO PIECE SLIDE

FIELD OF THE INVENTION

The present invention is in the field of consumer backyard slides.

DISCUSSION OF RELATED ART

A variety of different backyard slides have been described in the prior art. For example, in United States publication number US20110086717A1 Adjustable Height Slide Base by inventor Christopher W. Connors published on Apr. 14, 2011 the abstract discloses, "A playset is operable to be erected on a site and includes a slide and an adjustable-height slide base. The slide base includes an adapter that attaches below the slide and at least one standoff that attaches below the adapter."

For example, in U.S. Pat. No. 5,860,867 Interlocking Playground Slide Sections by inventor Gary Van Deusen published on Jan. 19, 1999 the abstract discloses, "A connection for interconnecting adjacent playground slide sections in end-to-end relationship wherein slide sections formed of molded synthetic material will be accurately aligned and the fasteners holding the sections together are recessed and do not interfere with the sliding surfaces. The interconnection utilizes a projection received within a complementary recess in an overlapping manner to produce a smooth aligned sliding surface relationship between adjacent slide sections capable of producing a high strength fastener produced connection."

For example, in U.S. Pat. No. 10,549,206 Assembled Slide by inventor Soebagiyo Nirwan published on Feb. 4, 2020 the abstract discloses, "An assembled slide is defined with a slide front side and a slide back side, comprises a head section, a connect section and a tail section. The head section is disposed with a first carrying portion at a head section first end facing the connect section, the connect section is disposed with a first lapping portion connected to the first carrying portion at a connect section first end facing the head section and a second carrying portion at a connect section second end facing the tail section, and the tail section is disposed with a second lapping portion connected to the second carrying portion at a tail section first end facing the connect section. The head section, connect section and tail section are respectively formed with at least one accommodating groove on an axis. At least one support rib is disposed in the at least one accommodating grooves."

For example, in U.S. Pat. No. 8,651,970B2 Playground Slide by inventor Samuel Chen published on Feb. 18, 2014 the abstract discloses, "A playground slide has a pair of side rails, including a left side rail and a right side rail, and the pair of side rails is parallel to each other. A slide sheet has a slide sheet top surface, and the slide sheet top surface has a slide sheet left edge. The slide sheet top surface has a slide sheet right edge, and the slight sheet left edge is mounted to a bottom surface of the left side rail. The slide sheet right edge is mounted to a bottom surface of the right side rail. A pair of support rails, namely a left support rail and a right support rail, supports the slight sheet. The pair of support rails is parallel to each other, and the pair of support rails is mounted to a bottom surface of the slide sheet between the pair of side rails."

For example, in U.S. Pat. No. 4,299,171 Demountable Flume Amusement Ride by inventor Howard L. Larson published on Nov. 10, 1981 the abstract discloses, "A flume of the type designed to carry a stream of water in which passenger carrying vessels float is built in sections that are formed nearly exclusively by fiberglass, structural strength being provided by fiberglass box beams integrally formed with the trough."

SUMMARY OF THE INVENTION

The present invention is a consumer backyard slide. A slide has a metal frame supporting a polymer slide portion. The slide portion has an upper slide section and a lower slide section connected to the upper slide section. The upper slide section and the lower slide section form an interface. The interface includes an interface middle section, an interface right upper extension, and an interface left upper extension. The interface middle section is offset from the interface right upper extension and the interface left upper extension. A left lengthwise interface section extends between the interface middle section and the interface left upper extension. A right lengthwise interface section extends between the interface middle section and the interface right upper extension. The left lengthwise interface section and the right lengthwise interface section are parallel to each other, but perpendicular to the interface middle section.

The upper slide section has a middle flange that fits to a middle slot formed on the lower slide section, wherein the middle flange overlaps the middle slot. The slide upper section includes a flange channel right protrusion that engages a mesa right indent of the middle slot formed on the lower slide section. The slide upper section includes a flange channel left protrusion that engages a mesa left indent of the middle slot formed on the lower slide section, wherein a mesa protrudes from between the mesa right indent and the mesa left indent on the lower slide section. The middle slot mesa fits with a middle flange channel formed as a depression on the middle flange.

The middle slot mesa has a left mesa protrusion and a right mesa protrusion. The flange channel has a left flange channel indent and a right flange channel indent. The left mesa protrusion is configured to engage the left flange channel indent. The right mesa protrusion is configured to engage the right flange channel indent.

The five bolts engage the lower slide section, and connect to five nuts embedded into the upper slide section. The five bolts engage the five nuts to secure the lower slide section to the upper slide section. The five bolts are vertically oriented to provide a uniform clamping force. The five bolts include a right slide bolt, a left slide bolt, a first middle bolt, a second middle bolt, and a third middle bolt. The right slide bolt engages a right bracket extension flange, and the left slide bolt engages a left bracket extension flange. The first middle bolt, second middle bolt, and third middle bolt are mounted to the middle slot mesa. The five nuts include a right slide nut, a left slide nut, a first middle nut, a second middle nut, and a third middle nut. The right slide nut is embedded into the right slide protrusion. The left slide nut is embedded into the left slide protrusion. The first middle nut, second middle nut, and third middle nut are embedded to the middle flange channel.

The slide upper section includes a flange channel right protrusion that engages a mesa right indent of the middle slot formed on the lower slide section. The slide upper section includes a flange channel left protrusion that engages a mesa left indent of the middle slot formed on the lower slide section. A flat mesa protrudes from between the mesa right indent and the mesa left indent on the lower slide section.

The flat profile of the middle slot mesa fits with a flat profile of the middle flange channel formed as a depression on the middle flange.

The following call out list of elements can be a useful guide in referencing the elements of the drawings.

11 Right Frame Support
12 Left Frame Support
13 Right Ladder Leg
14 Left Ladder Leg
15 Right Leg
16 Left Leg
17 First Rung
18 Second Rung
19 Third Rung
21 Right Crossbar
22 Left Cross Bar
23 Right Ladder Handle
24 Left Ladder Handle
25 Right Front Slide Leg
26 Left Front Slide Leg
27 Front Footing
28 Front Footing Base
30 Lower Slide Section
31 Right Slide Foot Retainer
32 Left Slide Foot Retainer
33 Middle Dip
34 Lower Dip
35 Upper Hump
36 Middle Hump
37 Right Guardrail
38 Left Guardrail
39 Section Joint Interface
40 Upper Slide Section
41 Upper Slide Section Notch
42 Upper Slide Crossbar
43 Right Lower Slide Section Mounting Flange
44 Right Upper Slide Section Bracket
45 Left Upper Slide Section Bracket
46 Left Lower Slide Section Mounting Flange
47 Upper Slide Section Lower Surface
147 Right Front Foot Anchor Section
148 Left Front Foot Anchor Section
50 Upper Interface Surface
51 Interface Middle Section
52 Left Lengthwise Interface Section
53 Right Lengthwise Interface Section
54 Left Interfaced Section
55 Right Interface Section
56 Interface Middle Section Protrusion
57 Left Upper Extension
58 Right Upper Extension
59 Lower Slide Section Upper Edge
61 First Channel
62 Second Channel
63 Third Channel
64 Fourth Channel
65 First Lower Support
66 Second Lower Support
67 Third Lower Support
68 Fourth Lower Support
69 Fifth Lower Support
70 Lower Slide Connection Interface 70
71 Left Slide Bolt
72 First Middle Bolt
73 Second Middle Bolt
74 Third Middle Bolt
75 Right Slide Bolt
76 Left Slide Indent
77 Right Slide Indent
78 Middle Slot
80 Upper Slide Connection Interface
81 Left Slide Nut
82 First Middle Nut
83 Second Middle Nut
84 Third Middle Nut
85 Right Slide Nut
86 Left Side Protrusion
87 Right Side Protrusion
88 Middle Flange
89 Middle Flange Channel
91 Left Mesa Protrusion
92 Right Mesa Protrusion
93 Left Flange Indent
94 Right Flange Channel Indent
95 Middle Slot Front Wall
96 Flange Channel Front Wall
97 Mesa Left Indent
98 Flange Channel Left Protrusion
99 Mesa Right Indent
101 Left Guardrail Receiving Face
102 Left Guardrail Extension Face
103 Left Bracket Extension Flange
104 Left Bracket Upper Face
105 Right Guardrail Receiving Face
106 Right Guardrail Extension Face
107 Right Bracket Upper Face
108 Right Bracket Extension Flange

DETAILED DESCRIPTION OF THE PREFERRED EMBODIMENT

Figure 1:
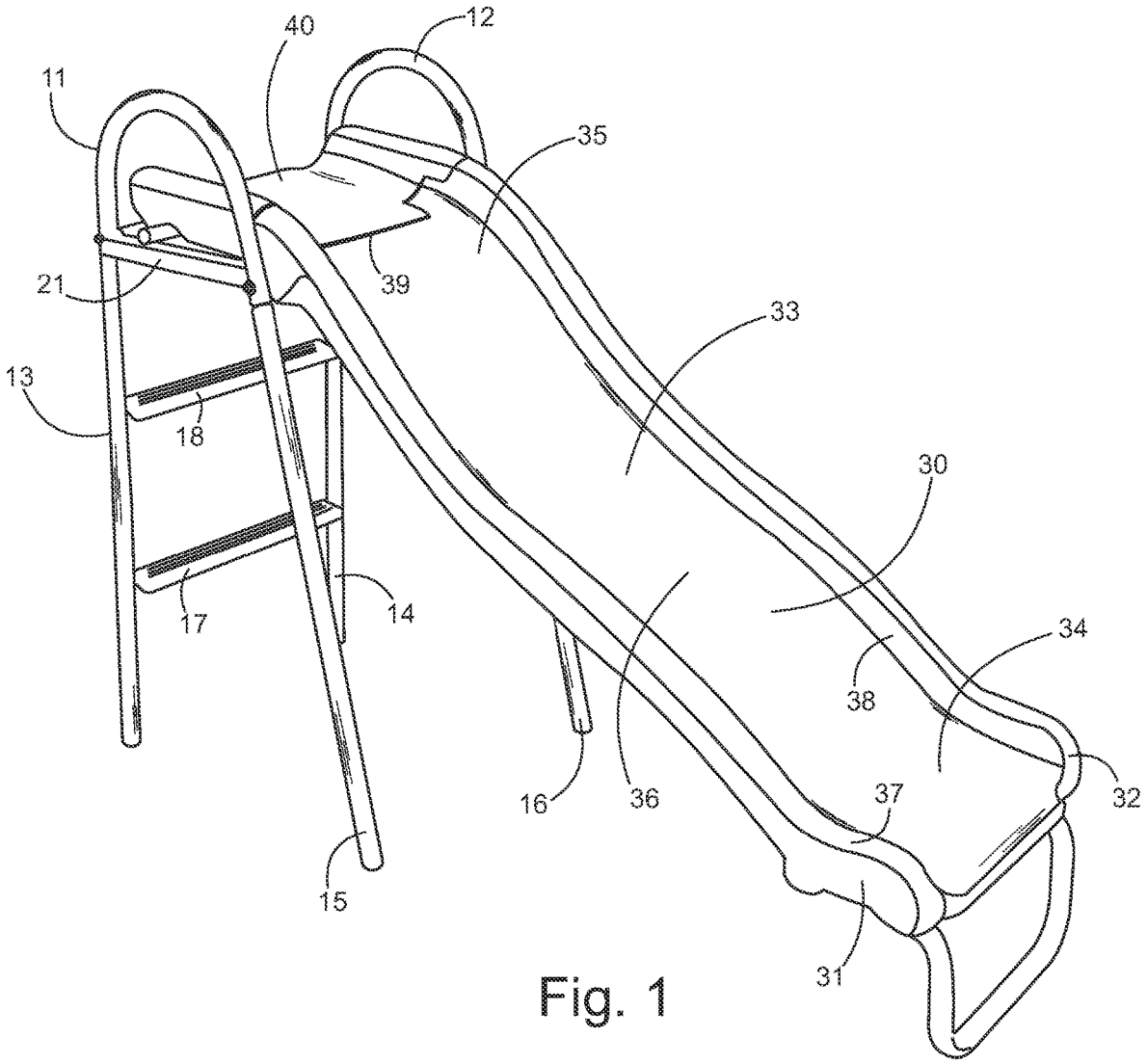
FIG. 1 is a right perspective right side view of the present invention.

As seen in FIG. 1, the slide generally has an upper slide section 40 and a lower slide section 30 supported by a frame. The upper slide section 40 is formed as a seat with an entry from the rear and a connection to the lower slide section in the front. The lower slide section 30 is formed as a ramp with a connection to the upper slide section 40 in the rear, and a slide exit in the front.

The frame includes a right frame support 11 and a left frame support 12. The right frame support 11 has a right ladder leg 13 and the left frame support 12 has a left ladder leg 14. The right frame support 11 also has a right leg 15 extending downwardly in front of the right ladder leg 13. The left frame support 12 also has a left leg 16 extending downwardly in front of the left ladder leg 14. The right frame support 11 connects to the left frame support 12 via horizontal structural connecting members which include a first rung 17, a second rung 18, and a right crossbar 21.

A slide foot supports the front of the slide at the lower portion of the slide. The slide foot fits into a right slide foot retainer 31 on a right side of the foot, and a left slide foot retainer 32 on the left side of the foot. The slide has an upper hump 35 that gently bends under a users legs when the user is sitting on the upper slide section 40 and ready to slide. The right frame support 11 and the left frame support 12 form a pair of curved handles for the right and left hands. A user can push off from the curved handles of the right frame support 11 and the left frame support 12. The middle dip 33 and a lower dip 34 have a middle hump 36 between them to provide an undulating slide surface that accelerates sliding speed. The lower dip 34 bends to a more flat angle at the exit of the slide. The right guardrail 37 and the left guardrail 38 provide a support for the slide structure and continue from the upper slide section 40 down to the lower slide section 30. The right guardrail 37 and the left guardrail 38 are also joined at a section joint interface 39. Preferably, the frame is made of galvanized or powder coated steel tubing and the slide portion is made of high density polyethylene.

Figure 2:
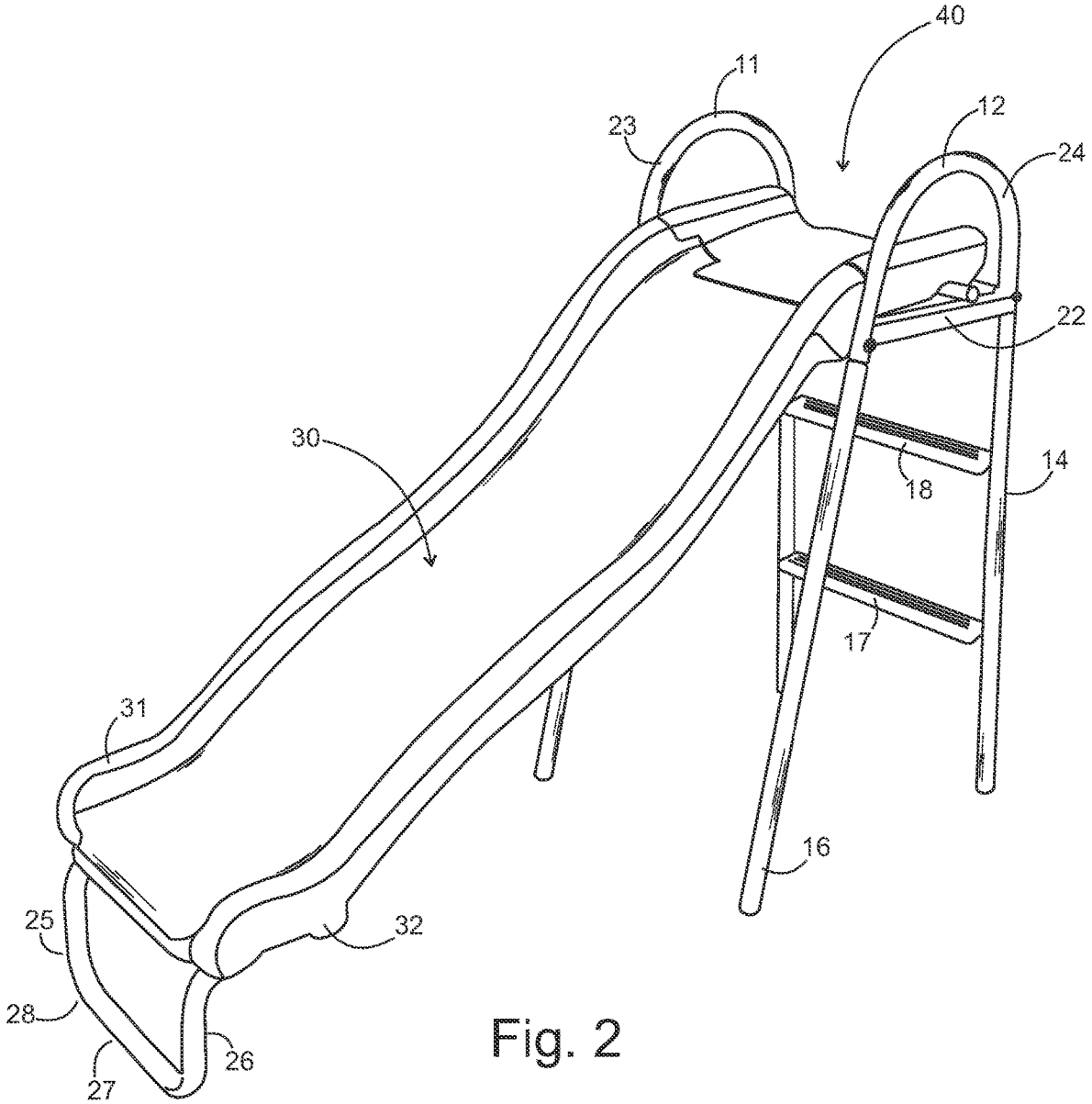
FIG. 2 is a left perspective left side view of the present invention.

As seen in FIG. 2, a right frame support 11 has a right ladder handle 23 that is generally semicircular at a top and a left frame support 12 that has a left ladder handle 24 that is generally semicircular at a top. The pair of semicircular ladder handles extend at least twice the height of the guardrails and extend downwardly to four legs in a generally parabolic. The first rung 17 and the second rung 18 can be stamped from a flat sheet of rectangular steel and powder coated on both sides. The rung feet grips can be stamped in long protrusions which increase the rigidity of the rung members. The rung members are preferably rectangular with a corrugated top, and downwardly extending sidewalls with a right rung notch receiving the right ladder leg, and a left rung notch receiving the left ladder leg. The right rung notch and the left rung notch are preferably rounded when the right ladder leg and the left ladder leg have a round tubular cross-section.

The left cross bar 22 extends from the left ladder leg 14 to the left leg 16 for providing additional stability. When the left lateral leg 14 and the left leg 16 rest on the ground, they may be on uneven ground and the left crossbar 22 may provide a tension support to prevent separation of the left ladder leg 14 from the left leg 16. The front footing 27 also provides additional stability. The front footing 27 is formed as a tube with a front footing base 28. The front footing base 28 is formed as a tubular steel horizontal member that rests on the ground. The right front slide leg 25 extends upwardly from a right side of the front footing base 28, and the left front slide leg 26 extends upwardly from a left side of the front footing base 28. The right front slide leg 25 left front slide leg 26 extend rearwardly underneath the slide and are respectively retained by right slide foot retainer 31 and a left slide foot retainer 32. The right slide foot retainer 31 and the left slide foot retainer 32 can be formed as pair of slots terminating at a bump underneath the front of the slide where the front footing 27 is attached.

Figure 3:
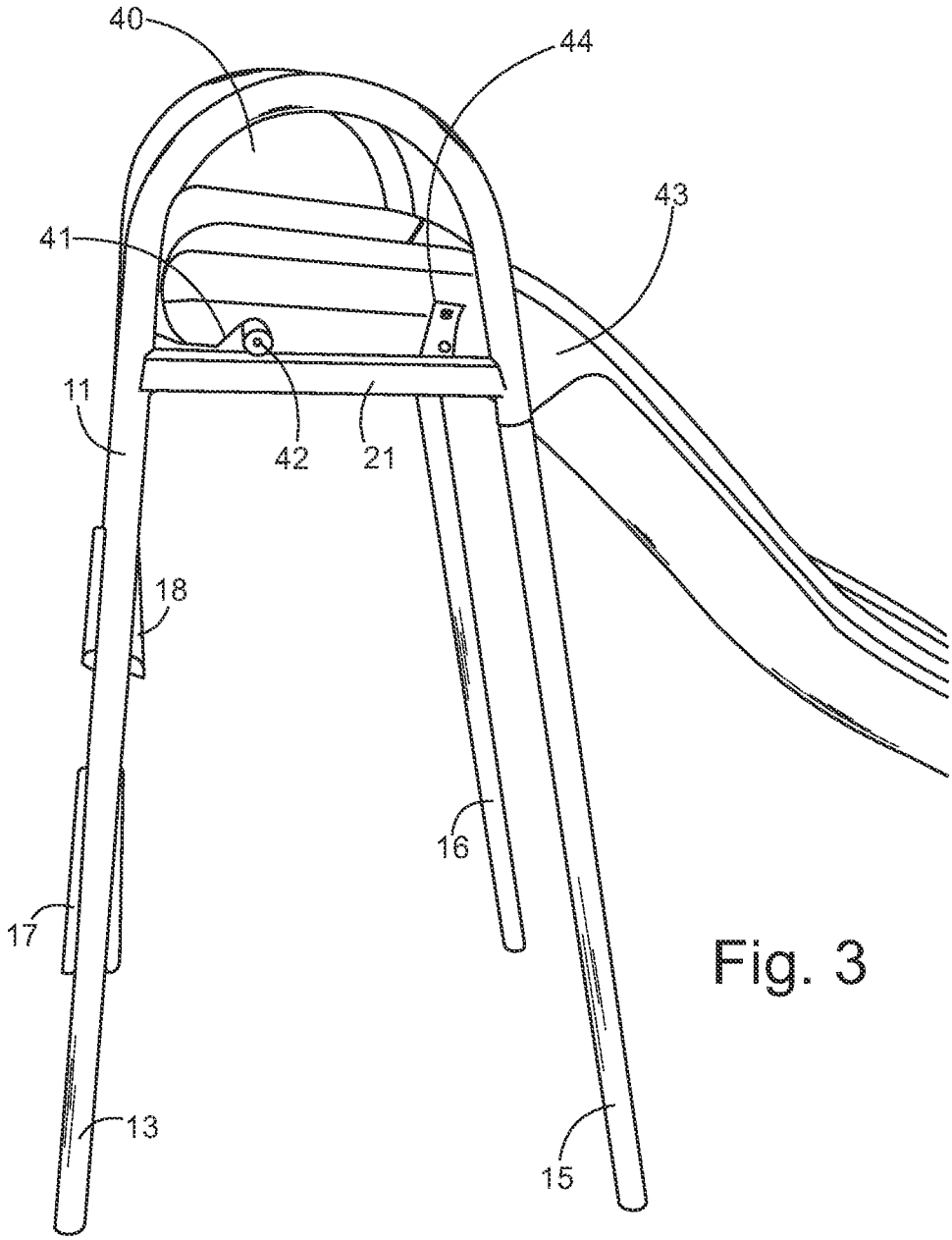
FIG. 3 is a right view of the present invention.
Figure 4:
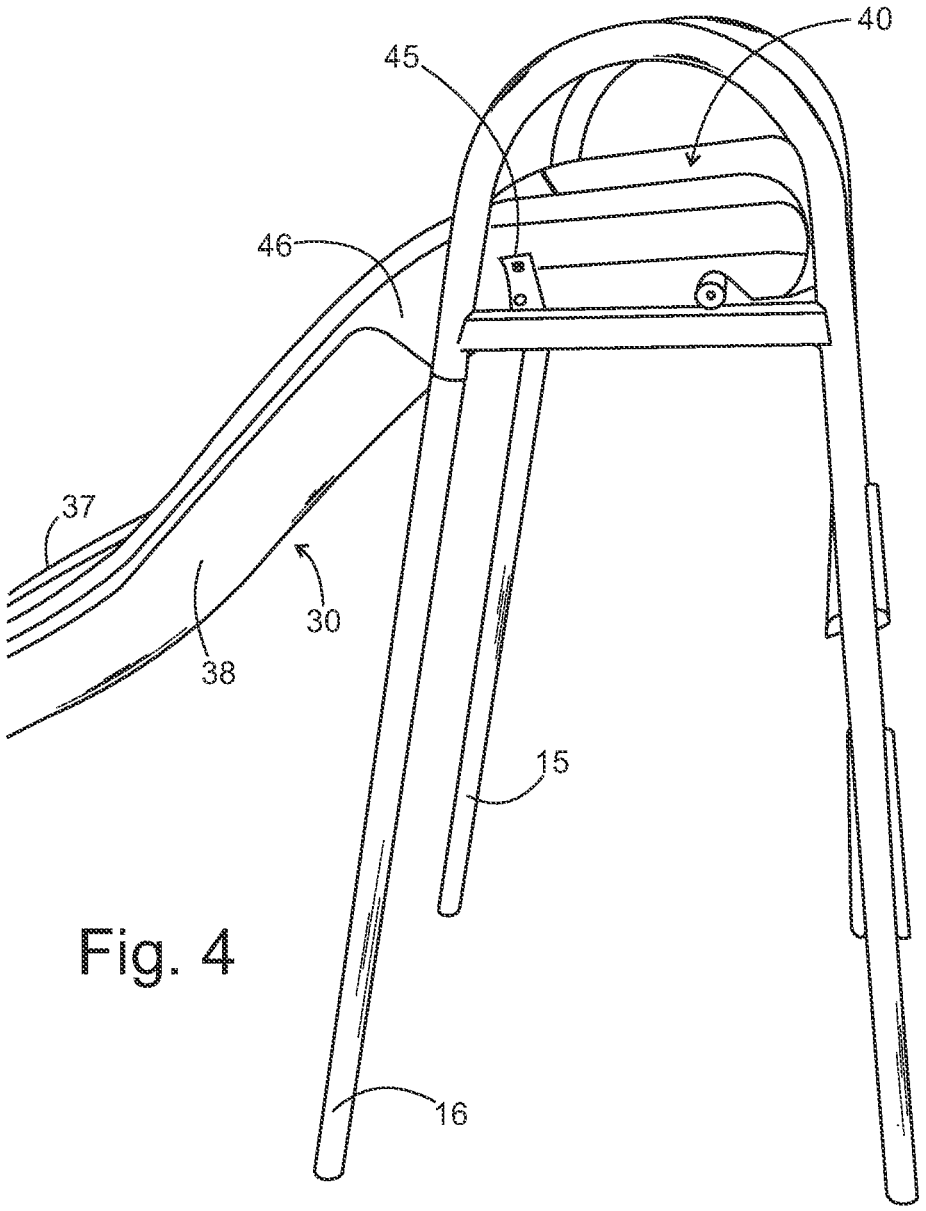
FIG. 4 is a left view of the present invention.

As seen in FIG. 3, the right frame support 11 includes a right ladder leg 13 and a right leg 15 that complements the left leg 16. The first rung 17 is preferably at about one third the height of the right crossbar 21, and the second rung 18 is preferably at about two thirds the height of the right crossbar 21. The user climbs to the upper slide section 40 and the upper slide section 40 has an upper slide section notch 41 that rests on an upper slide crossbar 42. The upper slide crossbar 42 cooperates with a right lower slide section mounting flange 43. The slide has an upper slide section 40 that connects to the lower slide section 30 at a right upper slide section bracket 44 which is formed by shaping the upper slide section 40 and the lower slide section 30 to fit together snugly. Similarly, as seen in FIG. 4, the left upper slide section bracket 45 and the left lower slide section mounting flange 46 also assist in structural rigidity. The left upper slide section bracket 45 is integrated to the left guardrail 38 and the left guardrail 38 appears continuous from the perspective of a user on the slide.

The left lower slide section mounting flange 46 is preferably connected to the left leg 16 just as the right lower slide section mounting flange 43 is connected to the right leg 15. The right guardrail 37 also appears continuous from the perspective of a user on the slide.

Figure 5:
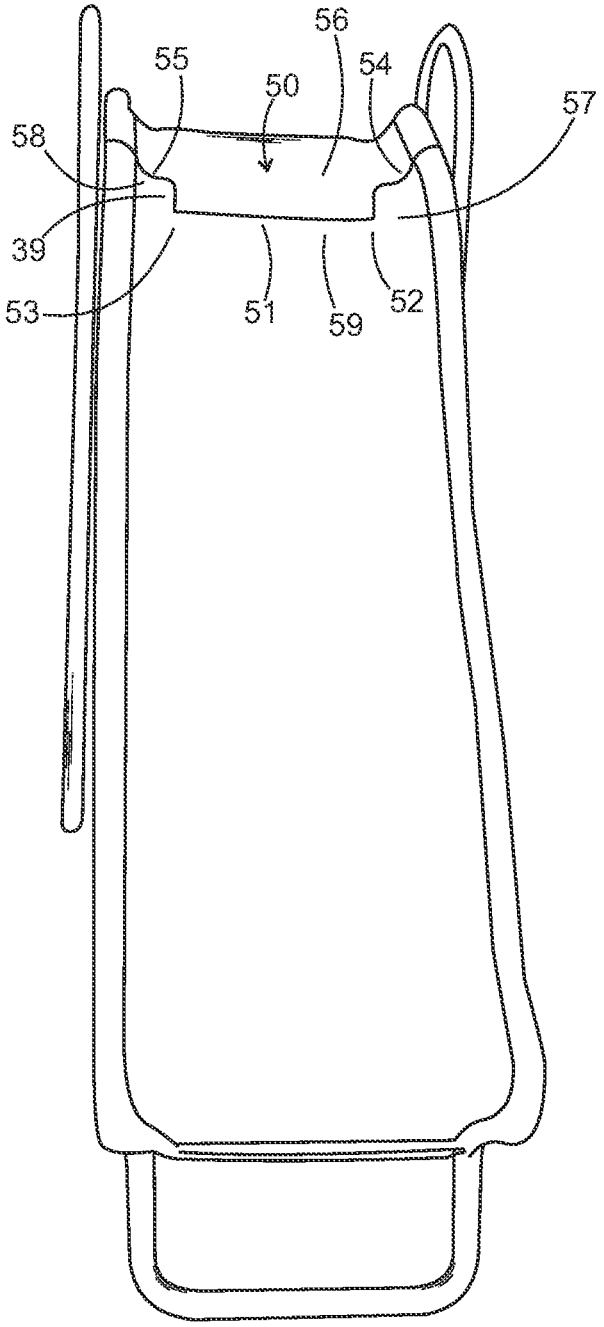
FIG. 5 is a front view of the present invention.

As seen in FIG. 5, the upper slide section 40 and the lower slide section 30 connect together at a section joint interface 39. The upper interface surface 50 on the upper surface of the slide has an interface middle section 51, left middle lengthwise interface 52, right lengthwise section 53, left interfaced section 54, and a right interface section 55. An interface middle section protrusion 56 is formed at the interface middle section 51 and protrudes downwardly. The interface middle section protrusion 56 is formed between the left upper extension 57 and the right upper extension 58. The left upper extension 57 extends upwardly at the left interface section 54, and the right upper extension 58 extends upwardly at the right interface section 55.

Figure 6:
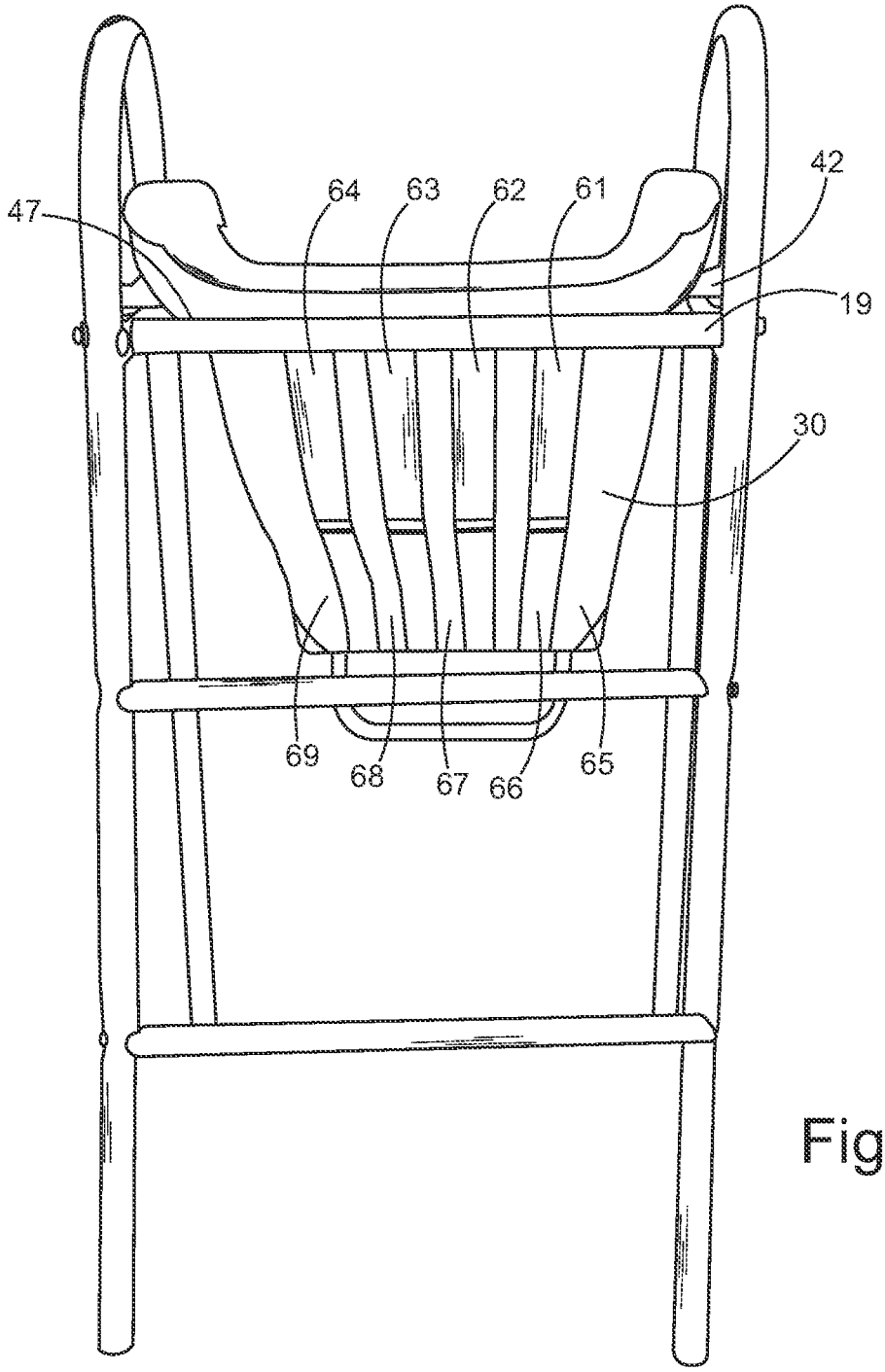
FIG. 6 is a rear view of the present invention.

The right interface section 55 is preferably parallel to the interface middle section 51. The left interface section 54 is preferably parallel to the interface middle section 51. The left lengthwise interface section 52 extends perpendicularly between the left interface section 54 and the interface middle section 51. The right lengthwise section 53 extends perpendicularly between the right interface section 55 and the interface middle section 51. The right lengthwise interface section 53 and the left lengthwise interface section 52 are preferably parallel to each other and As seen in FIG. 6, the upper slide section lower surface 47 of the lower slide section 30 is shaped to receive the third rung 19 at a partially recessed area of the upper slide section lower surface. The slide generally has a first lower support 65, second lower support 66, third lower support 67, fourth lower support 68, and fifth lower support 69. A first channel 61 is formed between the first lower support 65 and a second lower support 66. A second channel 62 is formed between the second lower support 66 and the third lower support 67. A third channel 63 is formed between the third lower support 67 and the fourth floor support 68. A fourth channel 64 is formed between the lower support 68 and the fifth lower support 69.

Figure 7:
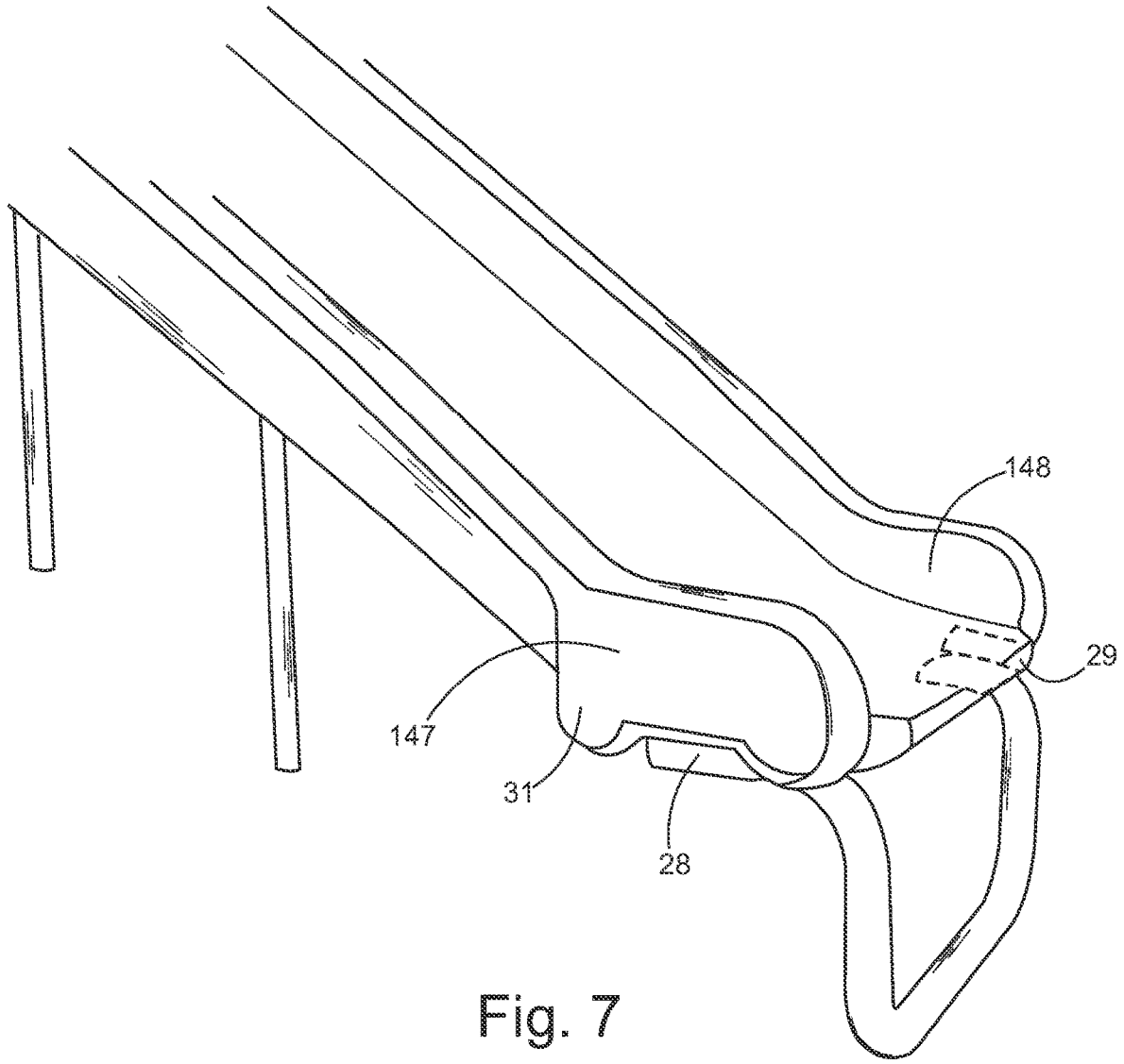
FIG. 7 is a perspective view of the present invention.

As seen in FIG. 7, the right slide leg slot 28 receives the right front slide leg 25, and the left slide leg slot 29 receives the left front slide leg 26. The right slide leg slot 28 and the left slide leg slot 29 are both formed on the upper slide section lower surface 47. The bumps at the end of the slots can be formed as a right front foot anchor section 147 and a left front foot anchor section 148.

Figure 8:
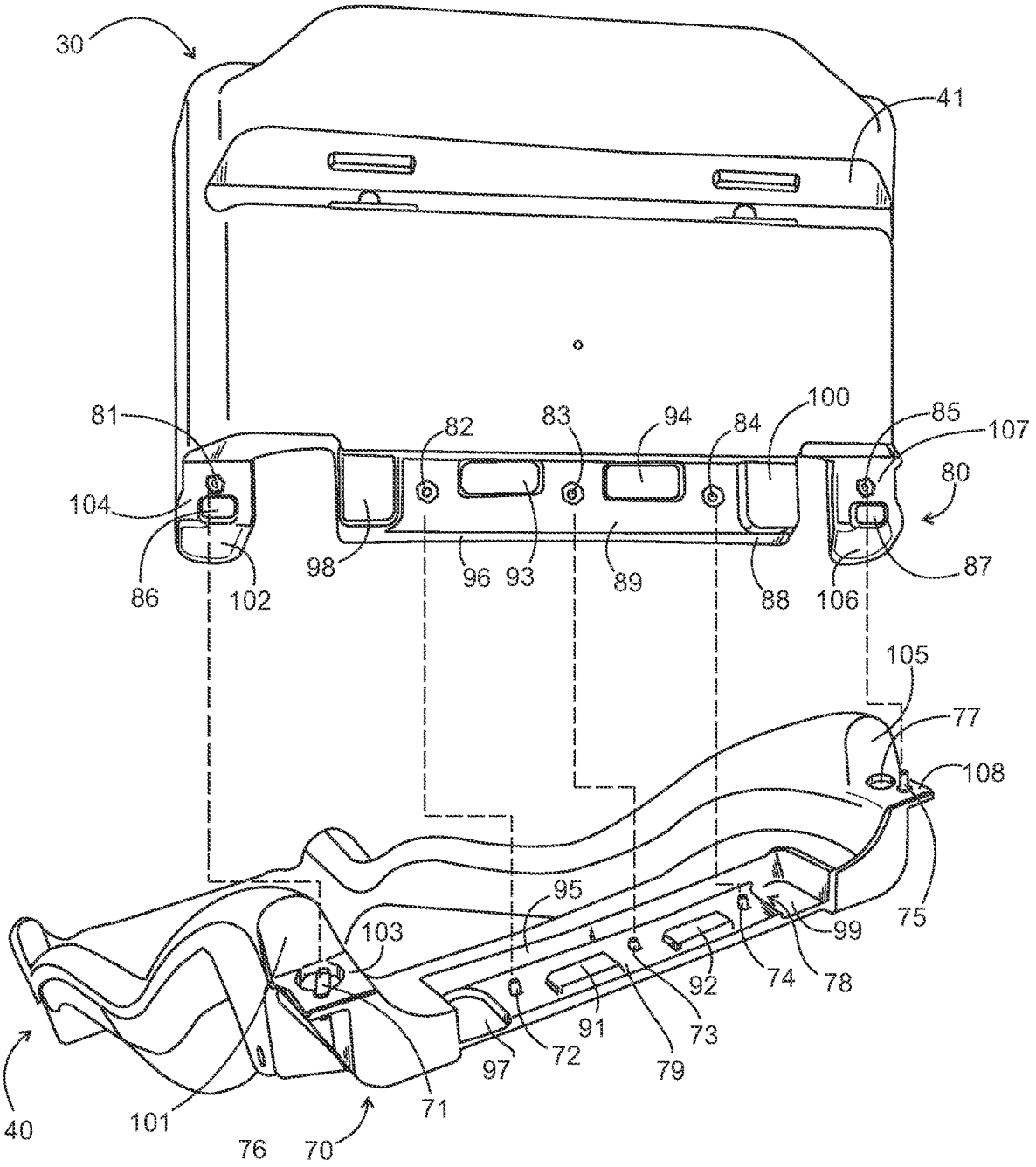
FIG. 8 an exploded view of the present invention.

As seen in FIG. 8, an exploded view of the present invention shows the upper slide section notch 41 with four elongated protrusions that are configured to retain the upper slide crossbar 42. Between the elongated protrusions, a pair of welding points formed as circular impressions can strengthen the connection between the top surface of the slide in the bottom surface of the slide when the slide is formed as a hollow plastic injection or rotationally molded member.

The upper and lower slide sections are connected by bolts and nuts. The lower slide section has a lower slide connection interface 70 and the upper slide section has an upper slide connection interface 80 that fit together with each other. The left slide bolt 71 fits to the left slide indent 76 to form the left upper slide section bracket 45. Similarly, the right slide bolt 75 fits to the right slide indent 77 to form the right upper slide section bracket 44. The left slide nut 81 can be embedded on the left slide protrusion 86 and aligned to the left slide indent 76 so that it receives the left slide bolt 71. Similarly, the right slide nut 85 is preferably embedded in the right slide protrusion 87 and aligned with the right slide indent 77 so that the right slide nut 85 aligns with and receives the right slide bolt 75.

The middle flange 88 extends from the upper slide section 40 towards the lower slide section 30 and has a middle flange channel 89 formed as a depression in the middle flange 88. The first middle nut 82, second middle nut 83, and third middle nut 84 are preferably embedded into the middle flange channel 89 of the middle flange 88. The first middle nut 82, second middle nut 83, and third middle nut 84 are mounted between the left slide nut 81 and the right slide nut 82.

The first middle bolt 72, second middle bolt 73, and third middle bolt 74 respectively engage to the first middle nut 82, second middle nut 83, and third middle nut 84. The first middle bolt 72, second middle bolt 73, and third middle bolt are mounted to the middle slot mesa 79 of the middle slot 78 formed on the lower slide section 30. The middle slot 78 is a depression on the lower slide section 30. The middle slot mesa 79 extends from the middle slot 78.

The left side protrusion 86 of the upper slide section has a left side protrusion nub that fits into the left slide indent 76 of the lower slide section. The right side protrusion 87 of the upper slide section has a right side protrusion nub that fits into a right slide indent 77 of the lower slide section.

The middle flange channel 89 has a left flange channel indent 93 and a right flange channel indent 94 respectively configured to fit into a left mesa protrusion 91 and a right mesa protrusion 92. The middle flange channel 89 fits with the middle slot mesa 79. The flange channel front wall 96 of the middle flange channel 89 abuts the middle slot mesa 79 at a middle slot mesa rear edge. Similarly, the middle slot front wall 95 abuts the front edge of the middle flange channel 89. The mesa left indent 97 and the mesa right indent 99 are indented below a level of the middle slot mesa 79 and respectively receive the flange channel left protrusion 98 and the flange channel right protrusion 100.

A left guardrail receiving face 101 of the lower slide section abuts the left guardrail extension face 102 of the upper slide section. A right guardrail receiving face 105 abuts the right guardrail extension face 106 of the upper slide section. The left bracket extension flange 103 abuts the left bracket upper face 104 while the right bracket upper face 107 abuts the right bracket extension flange 108.

The mesas, protrusions and indentations that cooperate with each other preferably have angled sides such that they bind when the bolts are tightened to the nuts. For example, the left mesa protrusion 91 and the right mesa protrusion 92 can be made as rectangular protrusions that have angled sidewalls. The angle of these angled sidewalls would match the angles of the mesa left indent 97 and the mesa right indent 99. The polymer or plastic exterior surface optionally may have a surface treatment with roughness that promotes binding when the bolts are tightened. The angled sidewalls automatically align the bolts to the nuts when the user presses the upper and lower slide sections together during assembly.

The invention claimed is:

1. A slide comprising:

a. a frame;

b. an upper slide section, wherein the upper slide section is made of polymer;

c. a lower slide section connected to the upper slide section, wherein the lower slide section and the upper slide section are supported by the frame, wherein the lower slide section is made of polymer;

d. an interface formed between the upper slide section and the lower slide section, wherein the interface includes an interface middle section, an interface right upper extension, and an interface left upper extension, wherein the interface middle section is offset from the interface right upper extension and the interface left upper extension;

e. a left lengthwise interface section extending between the interface middle section and the interface left upper extension; and f. a right lengthwise interface section extending between the interface middle section and the interface right upper extension, wherein the left lengthwise interface section and the right lengthwise interface section are parallel to each other, but perpendicular to the interface middle section, wherein the slide upper section includes a flange channel right protrusion that engages a mesa right indent of the middle slot formed on the lower slide section, wherein the slide upper section includes a flange channel left protrusion that engages a mesa left indent of the middle slot formed on the lower slide section, wherein a mesa protrudes from between the mesa right indent and the mesa left indent on the lower slide section, wherein the middle slot mesa fits with a middle flange channel formed as a depression on the middle flange.

2. The slide of claim 1, wherein the middle slot mesa has a left mesa protrusion and a right mesa protrusion, wherein the flange channel has a left flange channel indent and a right flange channel indent, wherein the left mesa protrusion is configured to engage the left flange channel indent, wherein the right mesa protrusion is configured to engage the right flange channel indent.

3. The slide of claim 2, further including five bolts engaging the lower slide section, and five nuts embedded into the upper slide section, wherein the five bolts engage the five nuts to secure the lower slide section to the upper slide section, wherein the five bolts are vertically oriented.

4. The slide of claim 3, wherein the five bolts include a right slide bolt, a left slide bolt, a first middle bolt, a second middle bolt, and a third middle bolt, wherein the right slide bolt engages a right bracket extension flange, wherein the left slide bolt engages a left bracket extension flange, wherein the first middle bolt, second middle bolt, and third middle bolt are mounted to the middle slot mesa, and wherein the five nuts include a right slide nut, a left slide nut, a first middle nut, a second middle nut, and a third middle nut, wherein the right slide nut is embedded into the right slide protrusion, wherein the left slide nut is embedded into the left slide protrusion, and wherein the first middle nut, second middle nut, and third middle nut are embedded to the middle flange channel.

5. The slide of claim 1, wherein the slide upper section includes a flange channel right protrusion that engages a mesa right indent of the middle slot formed on the lower slide section, wherein the slide upper section includes a flange channel left protrusion that engages a mesa left indent of the middle slot formed on the lower slide section, wherein a mesa protrudes from between the mesa right indent and the mesa left indent on the lower slide section, wherein the middle slot mesa fits with a middle flange channel formed as a depression on the middle flange.

6. The slide of claim 5, wherein the middle slot mesa has a left mesa protrusion and a right mesa protrusion, wherein the flange channel has a left flange channel indent and a right flange channel indent, wherein the left mesa protrusion is configured to engage the left flange channel indent, wherein the right mesa protrusion is configured to engage the right flange channel indent.

7. The slide of claim 6, further including five bolts engaging the lower slide section, and five nuts embedded into the upper slide section, wherein the five bolts engage the five nuts to secure the lower slide section to the upper slide section, wherein the five bolts are vertically oriented.

8. The slide of claim 7, wherein the five bolts include a right slide bolt, a left slide bolt, a first middle bolt, a second middle bolt, and a third middle bolt, wherein the right slide bolt engages a right bracket extension flange, wherein the left slide bolt engages a left bracket extension flange, wherein the first middle bolt, second middle bolt, and third middle bolt are mounted to the middle slot mesa, and wherein the five nuts include a right slide nut, a left slide nut, a first middle nut, a second middle nut, and a third middle nut, wherein the right slide nut is embedded into the right slide protrusion, wherein the left slide nut is embedded into the left slide protrusion, and wherein the first middle nut, second middle nut, and third middle nut are embedded to the middle flange channel.

9. A slide comprising:

a. a frame;

b. an upper slide section, wherein the upper slide section is made of polymer;

c. a lower slide section connected to the upper slide section, wherein the lower slide section and the upper slide section are supported by the frame, wherein the lower slide section is made of polymer;

d. an interface formed between the upper slide section and the lower slide section, wherein the interface includes an interface middle section, an interface right upper extension, and an interface left upper extension, wherein the interface middle section is formed between the interface right upper extension and the interface left upper extension, wherein the interface middle section is formed to the left of the interface right upper extension, and wherein the interface middle section is formed to the right of the interface left upper extension, wherein the interface middle section is at a lower level than the interface left upper extension and wherein the interface middle section is at a lower level than the interface right upper extension; and e. a middle flange, wherein the middle flange is formed on the upper slide section and protrudes from the upper slide section, wherein the middle flange fits to a middle slot formed on the lower slide section, wherein the middle flange overlaps the middle slot, wherein the slide upper section includes a flange channel right protrusion that engages a mesa right indent of the middle slot formed on the lower slide section, wherein the slide upper section includes a flange channel left protrusion that engages a mesa left indent of the middle slot formed on the lower slide section, wherein a mesa protrudes from between the mesa right indent and the mesa left indent on the lower slide section, wherein the middle slot mesa fits with a middle flange channel formed as a depression on the middle flange.

10. The slide of claim 9, wherein the middle slot mesa has a left mesa protrusion and a right mesa protrusion, wherein the flange channel has a left flange channel indent and a right flange channel indent, wherein the left mesa protrusion is configured to engage the left flange channel indent, wherein the right mesa protrusion is configured to engage the right flange channel indent.

11. The slide of claim 10, further including five bolts engaging the lower slide section, and five nuts embedded into the upper slide section, wherein the five bolts engage the five nuts to secure the lower slide section to the upper slide section, wherein the five bolts are vertically oriented.

12. The slide of claim 11, wherein the five bolts include a right slide bolt, a left slide bolt, a first middle bolt, a second middle bolt, and a third middle bolt, wherein the right slide bolt engages a right bracket extension flange, wherein the left slide bolt engages a left bracket extension flange, wherein the first middle bolt, second middle bolt, and third middle bolt are mounted to the middle slot mesa, and wherein the five nuts include a right slide nut, a left slide nut, a first middle nut, a second middle nut, and a third middle nut, wherein the right slide nut is embedded into the right slide protrusion, wherein the left slide nut is embedded into the left slide protrusion, and wherein the first middle nut, second middle nut, and third middle nut are embedded to the middle flange channel.

* * * * *